US009852668B2

(12) United States Patent
Peters

(10) Patent No.: US 9,852,668 B2
(45) Date of Patent: Dec. 26, 2017

(54) FLAG AND BANNER HANGING APPARATUS AND INSTALL METHOD

(71) Applicant: Calvin R. Peters, Grandville, MI (US)

(72) Inventor: Calvin R. Peters, Grandville, MI (US)

( * ) Notice: Subject to any disclaimer, the term of this patent is extended or adjusted under 35 U.S.C. 154(b) by 313 days.

(21) Appl. No.: 14/567,073

(22) Filed: Dec. 11, 2014

(65) Prior Publication Data

US 2015/0194081 A1 Jul. 9, 2015

Related U.S. Application Data

(60) Provisional application No. 61/924,910, filed on Jan. 8, 2014.

(51) Int. Cl.

| | |
|---|---|
| ***A47B 96/06*** | (2006.01) |
| ***A47G 29/00*** | (2006.01) |
| ***A47K 1/00*** | (2006.01) |
| ***E04G 3/00*** | (2006.01) |
| ***E04G 5/06*** | (2006.01) |
| ***F21V 21/00*** | (2006.01) |
| ***F21V 35/00*** | (2006.01) |
| ***G09F 17/00*** | (2006.01) |

(52) U.S. Cl.

CPC ..... *G09F 17/00* (2013.01); *G09F 2017/005* (2013.01)

(58) Field of Classification Search

CPC ..... G09F 2007/1804; G09F 2007/1808; G09F 2007/1813; G09F 2007/1817; G09F 2007/1821; G09F 2007/1826; G09F 2007/183

USPC ..... 248/544, 690, 558, 27.3, 220.21, 218.4, 248/219.1, 219.2, 219.3, 219.4, 220.22, 248/221.11, 222.11, 222.13, 223.41, 248/224.51, 224.61, 225.11, 507; 116/173, 174, 175

See application file for complete search history.

(56) References Cited

U.S. PATENT DOCUMENTS 3,272,463 A * 9/1966 Greig ..... H01B 17/16 174/158 R
4,340,199 A * 7/1982 Brock ..... A47G 1/215 248/222.11
4,880,195 A * 11/1989 Lepley ..... G09F 17/00 248/219.3

(Continued)

*Primary Examiner* — Terrell McKinnon
*Assistant Examiner* — Michael McDuffie
(74) *Attorney, Agent, or Firm* — Frank M. Scutch, III

(57) ABSTRACT

An apparatus and related methods includes a base attached to an upright structure (such as a street light pole), a mounting bracket that releasably engages the base while supporting a hanging banner, and an install adapter that releasably holds the mounting bracket and banner until the mounting bracket attaches to the base. A removal adapter facilitates disengaging the mounting bracket and banner from the base. The mounting bracket and install adapter (and removal adapter) are attached to a pole and engage (and disengage) remotely and without using separate fasteners, thus allowing a worker to install (or remove) banners high on the upright structure while standing on the ground. The base and mounting bracket have tapered shapes that wedgingly engage, secured by a spring-biased friction retainer. The install adapter and removal adapter have structures that facilitate remote install and removal of the mounting bracket from the base.

21 Claims, 20 Drawing Sheets

(56) References Cited

U.S. PATENT DOCUMENTS 5,188,332 A * 2/1993 Callas ..... G09F 7/18 248/206.5
5,267,764 A * 12/1993 Hoffman ..... E04B 9/18 248/340
5,381,991 A * 1/1995 Stocker ..... G09F 7/18 248/206.5
5,388,794 A * 2/1995 Wolff ..... G09F 17/00 248/219.4
5,463,973 A * 11/1995 Tait ..... F16M 13/02 116/173
5,632,519 A * 5/1997 Stock ..... A47F 5/0892 294/210
5,709,057 A * 1/1998 Johnson, Jr. ..... G09F 7/18 248/219.2
5,759,121 A * 6/1998 Rogers ..... A63B 63/083 248/222.13
5,938,255 A * 8/1999 Rose ..... A47F 13/06 248/340
6,193,436 B1 * 2/2001 Ellis ..... A47B 13/021 248/219.4
6,378,820 B1 * 4/2002 Mooney ..... G09F 17/00 116/173
7,429,067 B1 * 9/2008 Rosa ..... F21V 19/04 248/303
7,810,265 B2 * 10/2010 Beatty ..... G09F 7/18 116/173
8,641,110 B1 * 2/2014 Perry ..... A47F 13/06 294/209
2003/0010274 A1 * 1/2003 McCudden ..... G09F 17/00 116/173
2013/0187018 A1 * 7/2013 Canfield ..... G09F 17/00 248/219.4
2013/0206938 A1 * 8/2013 Clouser ..... F16M 13/022 248/219.4
2015/0310779 A1 * 10/2015 Raymond, III ..... G09F 17/00 116/173
2016/0203741 A1 * 7/2016 White ..... G09F 7/18 248/544

* cited by examiner

FLAG AND BANNER HANGING APPARATUS AND INSTALL METHOD

This application claims benefit under 35 USC section 119(e) of U.S. Provisional Application Ser. No. 61/924,910, filed Jan. 8, 2014, entitled FLAG AND BANNER HANGING APPARATUS AND INSTALL METHOD, the entire contents of which are incorporated herein in their entirety.

BACKGROUND OF THE INVENTION

The present invention relates a seasonal flag and banner hanging apparatus and method, and more particularly relates to an apparatus and method for hanging seasonal flags/banners that allows the installer/remover to stand on the ground while installing/removing flags from their pole/post mounting brackets.

Many entities hang flags and banners (hereafter generally referred to as "banners") from posts, poles, buildings and other upright structures. The reasons are varied, and range from improving the appearance of city streets, to advertising, to promoting team products and activities, to celebrating holidays and special events. Known systems for hanging the flags and banners require that the installer/remover be at a height of the flag/banner in order to attach (or detach) the flag/banner to mounting brackets. For example, see FIG. 43 which illustrates one method in prior art. Also, ladders and other means can be used.

However, known prior art methods and apparatus are less efficient than desired, require considerable man-power and capital equipment, and require effort to make them safe and to limit liability during installation/removal. Also, known prior art methods and apparatus often tend to unacceptably require disruption of traffic flow during installation/removal. For example, the illustrated method of FIG. 43 lifts a worker high in the air by a utility lift truck with personnel basket, but is relatively costly (since it requires a lift truck or other expensive capital equipment), less safe than desired (since the worker is lifted high above ground), cumbersome (since the connection often requires separate bolts/zip-ties/or/fasteners), is labor intensive, and requires that the adjacent area be temporarily roped off or closed (so that pedestrians and/or vehicles don't pass under the worker). An improvement is desired that provides savings/improvements in terms of cost, capital investment, efficiency of install and removal, and safety. Also, an improvement is desired that potentially eliminates the need for traffic engineering services while working from a road right of way to install or remove the banners/flags.

SUMMARY OF THE INVENTION

In one aspect of the present invention, an apparatus for hanging a banner on an upright structure, comprises a base configured for attachment to the upright structure; a mounting bracket constructed to releasably engage the base while supporting the banner; and an install adapter constructed to releasably carry the mounting bracket but that releases when the mounting bracket is secured to the base.

In another aspect of the present invention, an apparatus for removing a banner hung on an upright structure, comprises a base configured for attachment to the upright structure; a mounting bracket engaging the base and supporting the banner; and a removal adapter constructed to engage the mounting bracket and release the mounting bracket from the base. The base, mounting bracket, and removal adapter are constructed to engage and disengage without using separate loose fasteners.

In another aspect of the present invention, an apparatus comprises an upright structure and a pair of bases attached to the upright structure; a banner assembly including a banner and a pair of mounting brackets constructed to releasably engage the bases while supporting the banner in a hanging position; and an installation tool including a pole and at least one install adapter attached atop the pole that is constructed to releasably hold the mounting bracket but then release when the mounting bracket becomes secured to the base.

In another aspect of the present invention, an apparatus for hanging a banner on an upright structure, comprises a base having first flanges to receive a band retainer for attaching the base to the upright structure and having second flanges defining a bracket-holding cavity; a mounting bracket having a mating portion shaped to wedgingly fit into the bracket-holding cavity and having a friction-generating retainer for holding the mounting bracket to the base, the mounting bracket also having a rod-supporting structure for supporting a banner-carrying rod; and an install adapter constructed to hold the mounting bracket during installation into the bracket-holding cavity, and constructed to then release the mounting bracket.

In another aspect of the present invention, a method for hanging a banner on an upright structure, comprises providing a base configured for attachment to the upright structure; providing a mounting bracket constructed to releasably engage the base while supporting the banner; providing an install adapter constructed to releasably hold the mounting bracket and then release when the mounting bracket is secured to the base; attaching the mounting bracket to install adapter and then using the install adapter to install the mounting bracket to the base without using separate fasteners; and disengaging the install adapter from the mounting bracket.

In another aspect of the present invention, a method for installing a banner hung on an upright structure, comprises providing a base, and a banner-carrying mounting bracket adapted to engage the base; and using a pole-mounted install adapter to engage the mounting bracket, then cause the mounting bracket to engage the base without using separate loose fasteners, with the install adapter releasing the mounting bracket after the mounting bracket is attached to the base.

In another aspect of the present invention, a method for removing a banner hung on an upright structure, comprises providing a base and a banner-carrying mounting bracket attached to the base; and using a pole-mounted removal adapter to engage the mounting bracket and cause the mounting bracket to disengage from the base without using separate loose fasteners.

In another aspect of the present invention, a method for hanging a banner on an upright structure comprises providing a base configured for attachment to the upright structure, providing a mounting bracket constructed to releasably engage the base while supporting the banner, providing an install adapter constructed to releasably hold the mounting bracket and then release when the mounting bracket is secured to the base, and attaching the mounting bracket to install adapter and then using the install adapter to install the mounting bracket to the base, and thereafter disengaging the install adapter from the mounting bracket, doing so remotely and without using separate fasteners.

In another aspect of the present invention, a method for removing a banner hung on an upright structure, comprises providing a base configured for attachment to the upright structure, providing a mounting bracket constructed to releasably engage the base while supporting the banner, providing a removal adapter constructed to engage the mounting bracket and release the mounting bracket from the base, and using the removal adapter to first engage the mounting bracket and then further using the removal adapter to cause the mounting bracket to disengage from the base, doing so remotely and without using separate fasteners.

In another aspect of the present invention, a method includes attaching at least one base to an upright structure, providing a banner assembly including a flexible banner and at least one mounting bracket, providing an installation tool including a pole and at least one install adapter attached atop the pole, using the installation tool to releasably engage the at least one mounting bracket with the base while supporting the flexible banner in a hanging position, and thereafter releasing the installation tool from the at least one mounting bracket when the mounting bracket becomes secured to the base.

In another aspect of the present invention, a method comprises providing a base having first flanges to receive retainer fasteners for attachment to the upright structure and second flanges defining a tapered cavity, providing a mounting bracket having a mating tapered portion shaped to wedgingly fit into the tapered cavity and having a friction-generating retainer for holding the mounting bracket to the base and also having a horizontal rod-supporting structure for supporting the banner on a rod that engages the rod-supporting structure, providing an install adapter constructed to hold the mounting bracket and then release the mounting bracket as the mating tapered portion fits into the tapered cavity, manipulating the mounting bracket using the install adapter to wedgingly fit the mounting bracket into the tapered cavity, and further manipulating the install adapter to disengage the install adapter with the mounting bracket.

These and other aspects, objects, and features of the present invention will be understood and appreciated by those skilled in the art upon studying the following specification, claims, and appended drawings.

DETAILED DESCRIPTION OF PREFERRED EMBODIMENT

Figure 3:
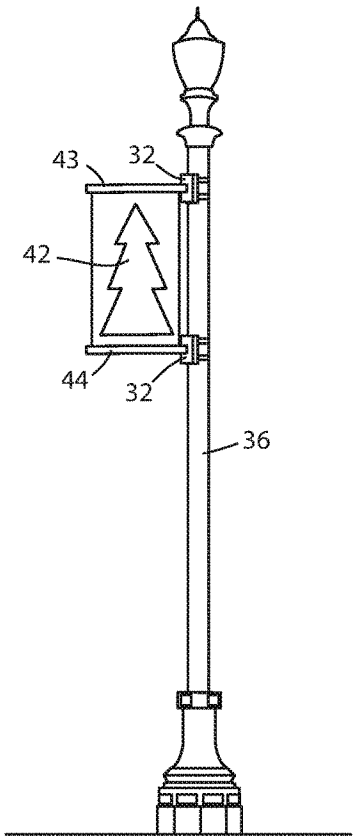
FIGS. 2-3 are elevational views similar to FIG. 1, but FIG. 2 shows the top mounting bracket attached to the top base (with the install adapter and second bracket/banner slightly lowered), and FIG. 3 showing both the top and bottom mounting brackets attached to respective bases on the pole (with the pole and install adapter completely pulled away).
Figure 2:
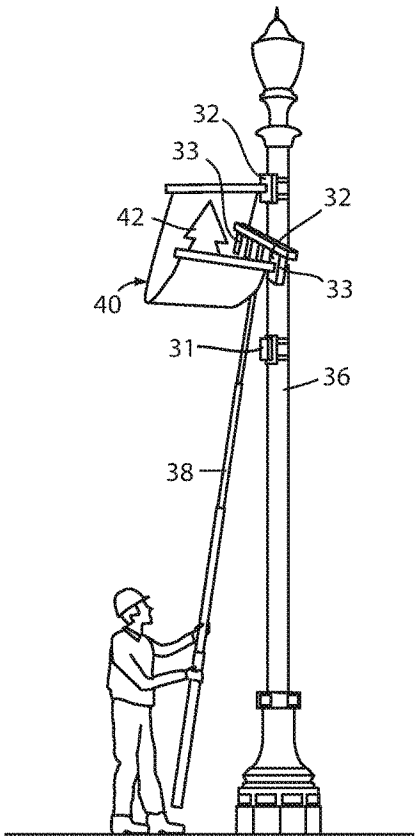
Figure 1:
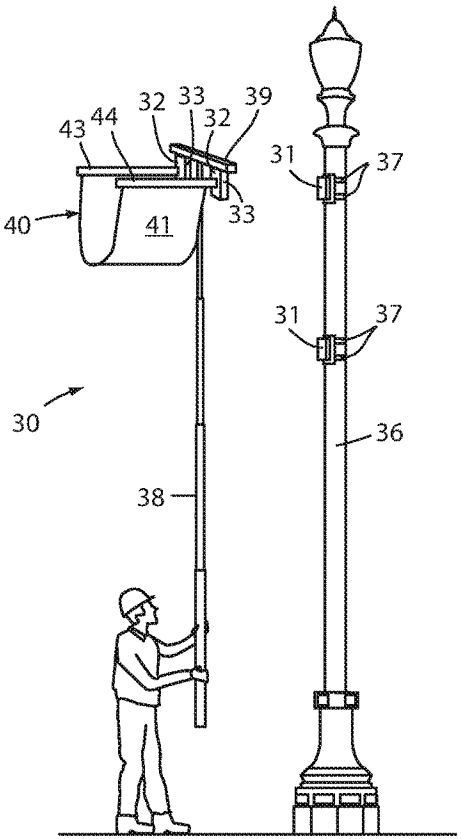
FIG. 1 is an elevational view showing an apparatus embodying the present invention including a base, a mounting bracket and an install adapter, the view showing a street light pole with two pre-attached spaced-apart bases, the worker holding a telescopingly extended pole with the install adapter at its top end, with the install adapter holding the two mounting brackets and the banner while being lifted to a position near a top of the street light pole for install onto the bases.
Figure 4:
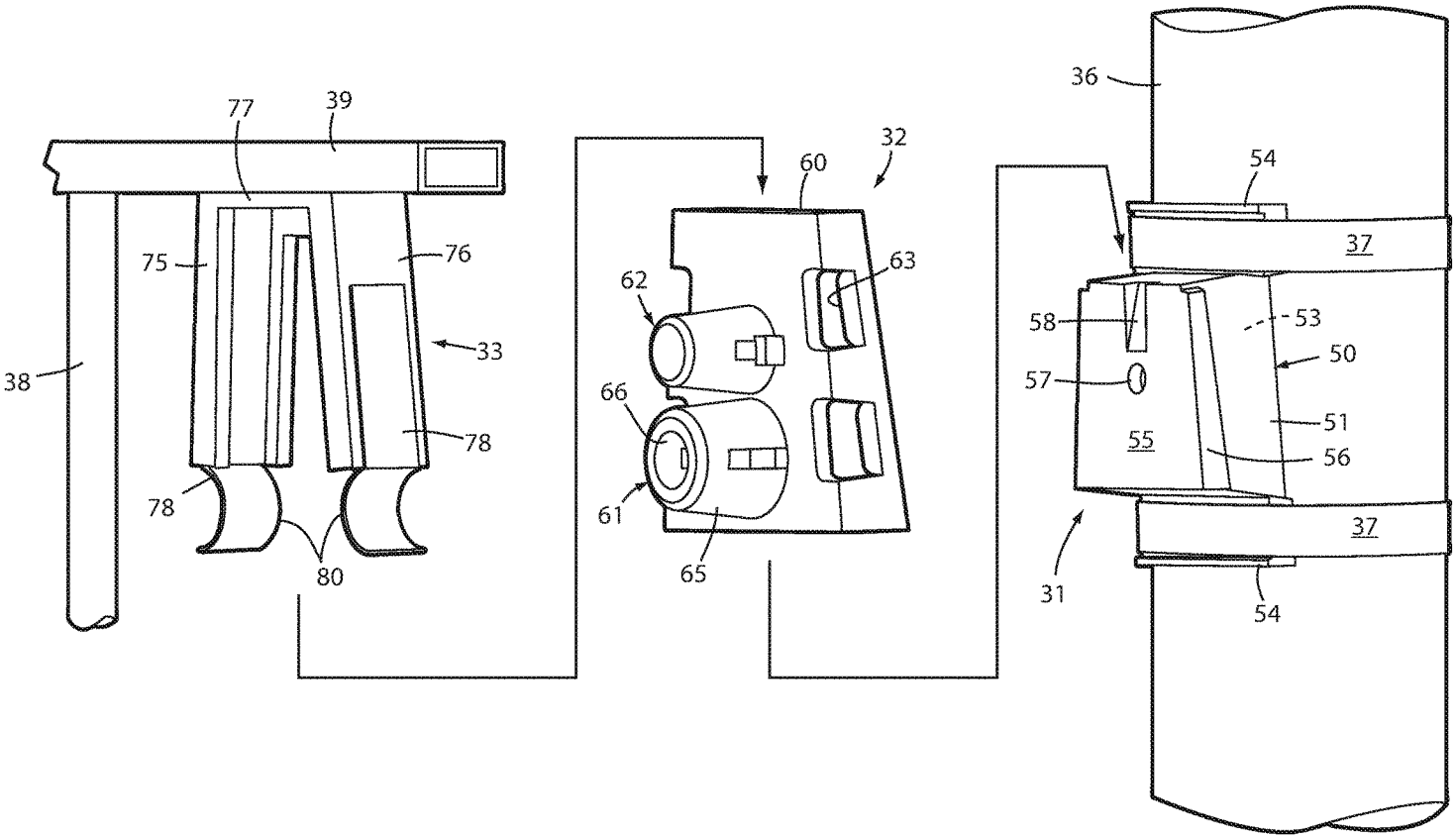
FIG. 4 is an exploded perspective view of the base, the mounting bracket, and the install adapter of FIG. 1, and including a line showing inter-engagement of components.
Figure 5:
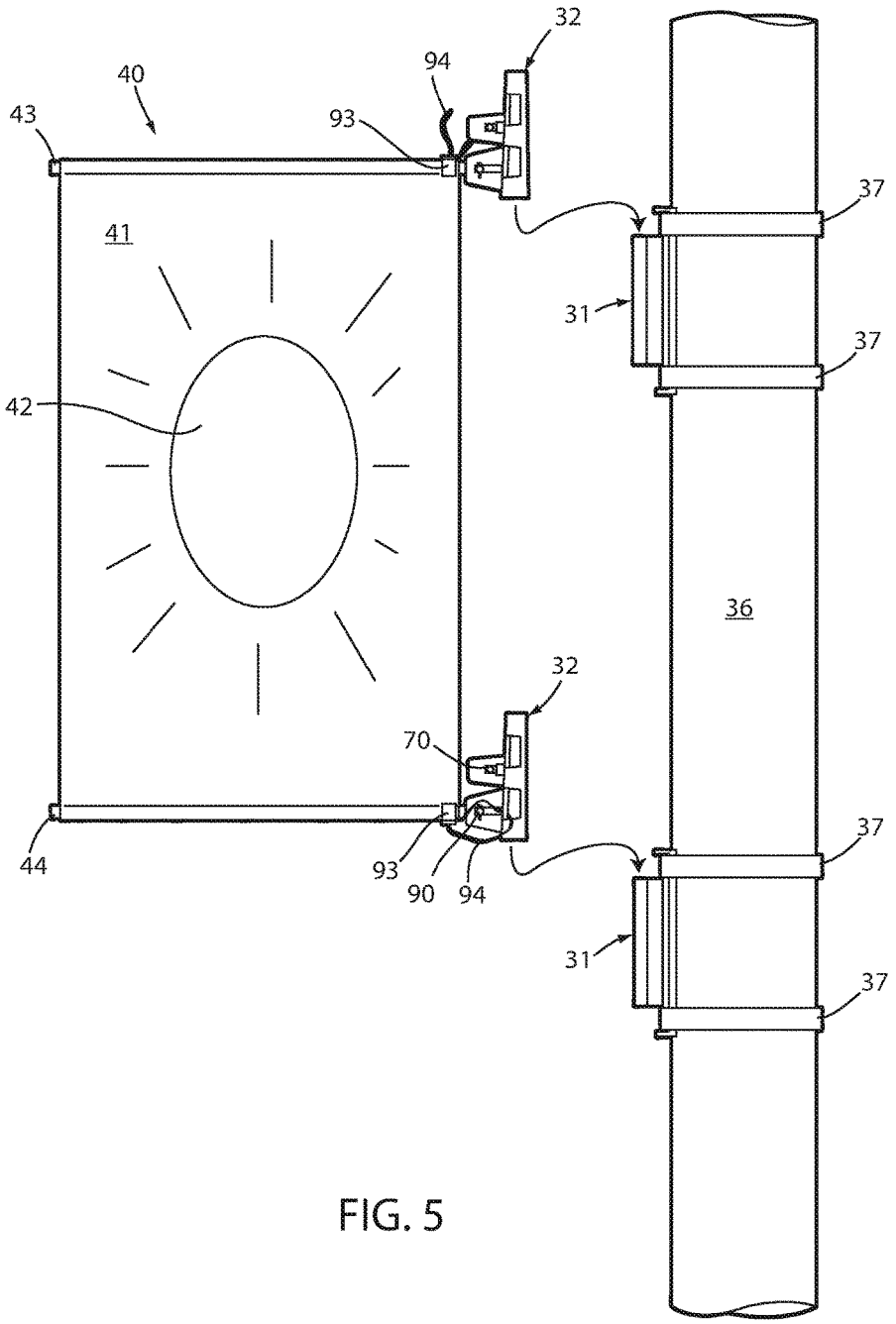
FIG. 5 is an enlarged view similar to a top of FIG. 1, but showing the banner with top/bottom rods and top/bottom mounting brackets, and showing a path of assembly of the top/bottom mounting brackets to the respective bases on the pole (the top being attached first).
Figure 8:
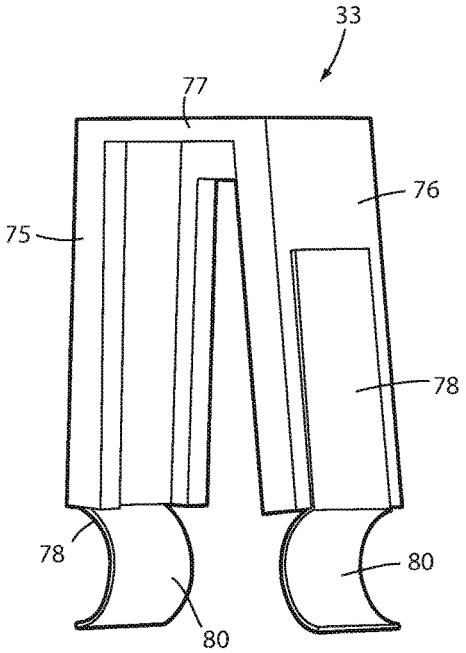
Figure 12:
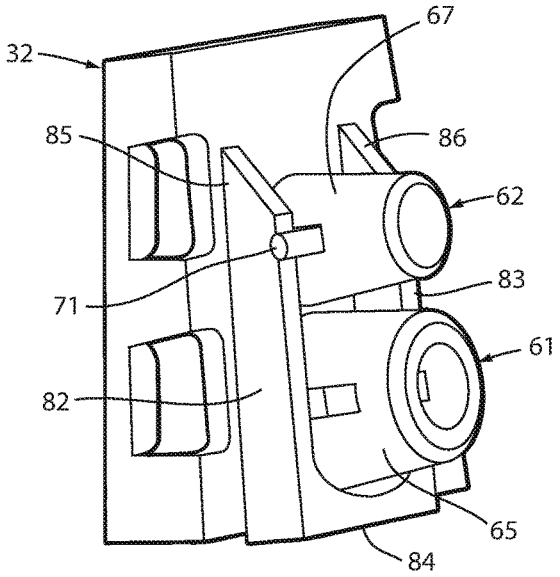
FIG. 12 is a perspective view of a removal adapter engaging the mounting bracket (see also FIG. 9B), the removal adapter engaging arms of the spring-biased retainer on the mounting bracket to release the retainer, thus facilitating removal of the mounting bracket from a given base, thus eliminating a need for separate loose fasteners and allowing the removal to be done from a remote position.
Figure 13:
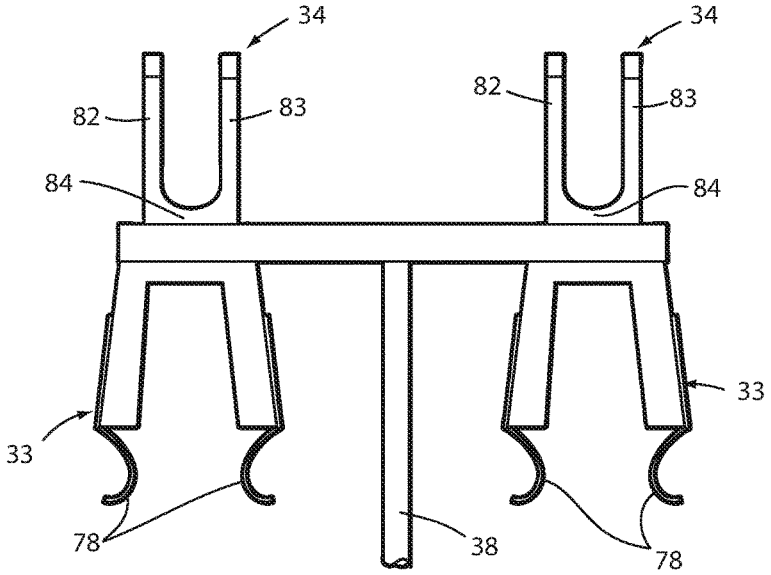
FIG. 13 is a side view of a modified apparatus that includes a pole, two down-facing spaced-apart install adapters (see FIG. 10) and two up-facing spaced-apart removal adapters (see FIG. 12).

The present apparatus 30 (also called "attachment system" herein, FIGS. 1-4) includes bases 31, mounting brackets 32, an install adapter 33 (FIGS. 4, 8), and further a removal adapter 34 (FIGS. 12-13). These components combine and cooperate to allow a worker to install a banner 40 high in the air while standing on the ground. FIGS. 1-3 illustrate a pair of based 31 on a street light pole, but it is contemplated that the base can be supported on any upright structure. Further, as used herein, the term "banner" is intended to cover flags, aesthetic decorative sheets/banners/fabrics, and/or other flexible sheets with indicia such as pictures, designs, information or writing/text/indicia thereon. More specifically, the present apparatus 30 includes a pair of spaced bases 31 attached to an upright structure 36 (such as the street light pole or building). The illustrated straps 37 attach two bases 31 to the street light pole, but it is contemplated that the base can be attached by any fastener desired, such as screws, bolts, zip ties, hooks, brackets, nails, adhesive, bonding, and the like. A manually-held telescopingly-extendable pole 38 includes a top end with transverse bar 39, with two spaced-apart install adapters 33 extending downward from the transverse bar 39. The banner 40 includes a flexible sheet 41 with indicia 42 thereon and with upper and lower horizontal rods 43, 44 supporting the banner 40 when installed. A mounting bracket 32 is attached to an inboard end of each rod 43, 44, and if desired, a clip or zip tie or other anti-slip component is used to keep the banner 40 from bunching toward one end of the rods 43, 44.

One method of installation proceeds as follows. The bases 31 are pre-installed on an upright support structure (e.g. street light pole or building) in a desired spaced-apart relationship. Two mounting brackets 32 (with rods 43, 44 fixed therein) are releasably engaged on the install adapters 33, with the banner 40 hanging between the rods. The extendable pole 38 is extended (with the worker standing on the ground), and the mounting brackets 32 are manipulated by the worker to first lower the top mounting bracket 32 into engagement with the top base 31 (see FIG. 2), and then secondly to lower the bottom mounting bracket 32 into engagement with the bottom base 31 (see FIG. 3). Once both mounting brackets 32 are attached to respective bases 31, the banner 40 (including sheet 41 and rods 43,44) are supported on the upright structure 36, with the banner 40 spread out between the rods 43,44 in a readable position. After installation, the extendable pole 38 with install adapters 33 can be pulled away. Notably, the present system does not require any separate loose fasteners, thus allowing remote manual installation without the need for separate hand tools or lift trucks or ladders. The present installation method is believed to be much safer, since the banner 40 can be hung by a worker positioned remotely from the banner 40 (i.e. on the ground and not with the worker positioned many feet above ground). Also, the banner 40 can be hung without using separate fasteners, and without all the cumbersomeness and difficulties presented when trying to manipulate fasteners while located high above the ground (and often, while experiencing difficult weather, e.g. cold, hot, windy, rainy, snowing, or other weather).

Figure 6:
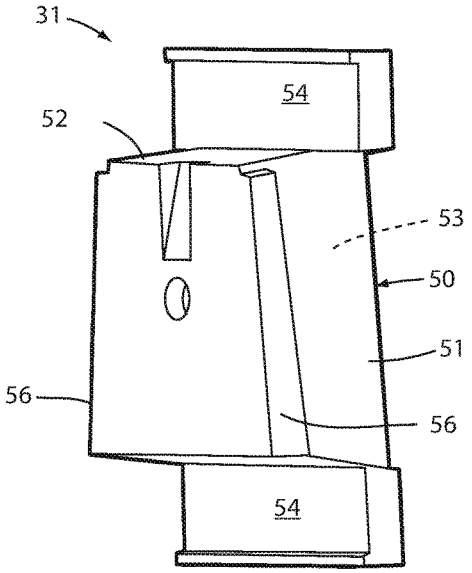
FIGS. 6-8 are perspective views of the base, mounting bracket and install adapter, respectively, from FIG. 4, which, in combination, eliminate a need for separate loose fasteners and that allow the installation to be done from a remote (ground) position.

The base 31 (FIG. 6) can be made from metal or polymeric or other structural material, and can be made from different methods, such as molding or machining. The illustrated base 31 is a polymeric molded body with first section 51 shaped to stably engage the upright structure 36 (such as a curve matching a shape of a street light pole), and an oppositely-facing second section 52 shaped to stably engage the mounting bracket 32. The first section 51 also includes on its "back side" a pair of lateral flanges 54 having a width and shape to receive straps 37 (or zip ties or a steel band) for "loop" attachment to the upright structure 36. Lateral flanges 54 may also include holes or other structure for receiving attachment bolts/screws/nails/hooks/brackets to retain the base 31 to the upright structure 36, depending on a shape/configuration of the existing upright structure 36. It is contemplated that the first section 51 can be shaped and configured to provide for attachment to many different upright structures, and for attachment by many different fastening devises. For example, it is contemplated that banners 40 could be attached to building walls and countless other structures providing a high location allowing for optimal visibility of a raised banner 40. The second section 52 includes a upwardly tapered protrusion 55 with edge flanges 56, a retainer hole 57, and ramp 58 at a center of its top region.

The mounting bracket 32 (FIG. 7) is a polymeric molded body having a mounting section 60, a boss-like banner-rod-engaging section 61 and a retainer section 62. The mounting section 60 includes flanges 63 defining a mating tapered cavity 64. The flanges 63 of the mounting section 60 are shaped to slidingly engage the edge flanges 56 on the tapered protrusion 55 for mating assembly of the mounting bracket 32 downwardly onto the base 31. The banner-rod engaging section 61 includes a cylindrical protrusion 65 with center hole for receiving the end of one of the banner rods 43, 44. The cylindrical protrusion 65 may include a latching hole 66 or an aperture or other feature allowing the rod 43 (or 44) to be positively anchored to the cylindrical protrusion 65. The banner 40 can be fixed to the rods 43 and 44 by a clip or other means so that the banner doesn't bunch to one end of the rods 43, 44. For example, a U-shaped clip on the rods or a zip tie tied to a feature of the mounting bracket itself can be used.

The retainer section 62 of the mounting bracket 32 (FIG. 9A) includes a hollow boss 67 with side slots 68 and standoffs 69. A T-shaped spring-biased retainer 70 (also called a "latch member" herein) includes opposing arms 71 that extend through slots 68, and includes a latch tip 72 shaped to engage the latching hole 66 in the base 31. A bias spring 73 biases the retainer 70 toward the base 31 to a locking position when the mounting bracket 32 is attached to the base 31. The ramp 58 is shaped so that when the mounting bracket 32 is lowered onto a given base 31, the ramp 58 slidingly engages the retainer to overcome the bias of the spring 73, causing the latch tip 72 to retract far enough to slip up and into the latching hole 66. The resulting retaining force and "action" is positive and robust, such that a worker can feel the positive engagement when it occurs. The bias spring 73 causes the opposing arms 71 to move into abutment with the standoffs 69, with the abutment providing sufficient space under the arms 71 for the wedge-tips of the removal adapter 34 to get under the arms 71 to release the latch member 70 from the latching hole 66 for removal, as discussed below (see FIG. 12).

Figure 7:
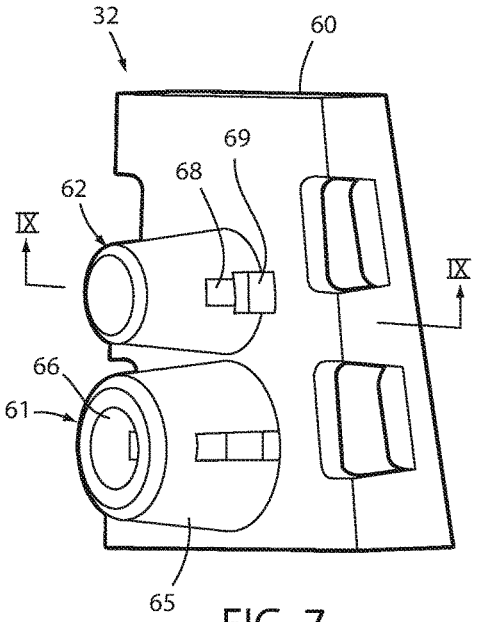
Figure 9A:
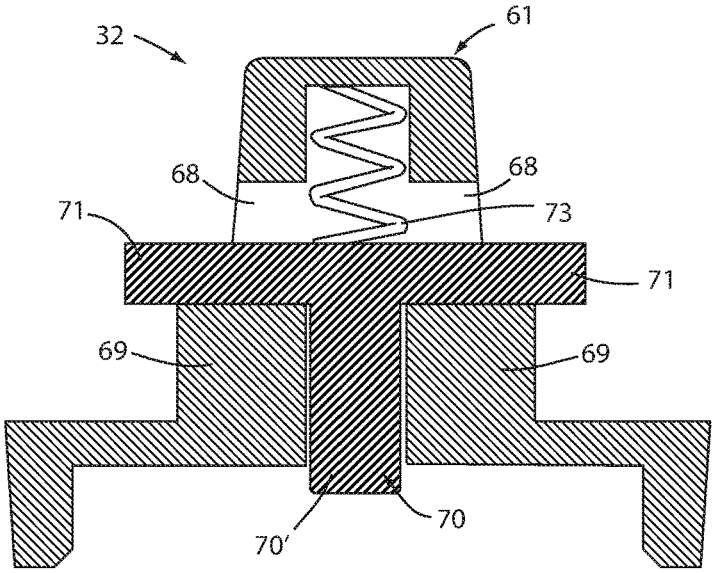
FIG. 9A is a cross sectional view of the mounting bracket taken along lines IX-IX in FIG. 7, the spring-biased retainer being shown in a locking position.
Figure 9B:
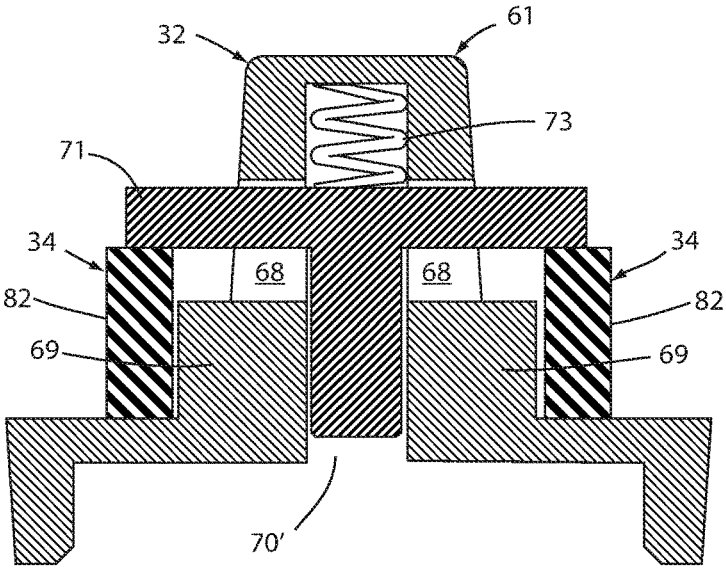
FIG. 9B is a cross sectional view similar to FIG. 9A, but showing the removal adapter with fingers holding the spring-biased retainer on the mounting bracket in a released position.
Figure 9C:
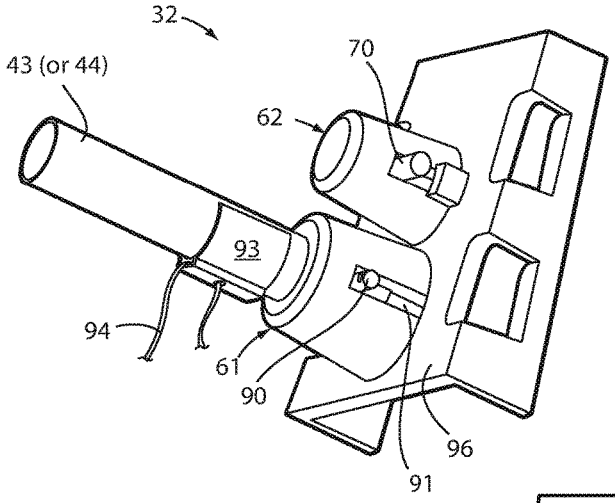
FIGS. 9C-9E are additional perspective views of the mounting bracket from FIG. 7, showing a relationship of the mounting bracket, the retainer, the retainer's biasing spring, one of the banner-carrying rods (see FIG. 5), a banner sheet-holding clip, and miscellaneous other components.
Figure 9D:
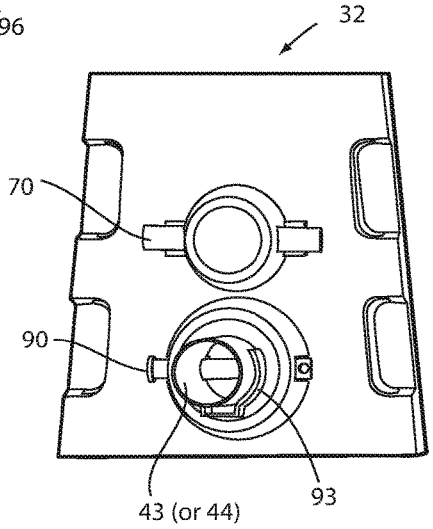
Figure 9E:
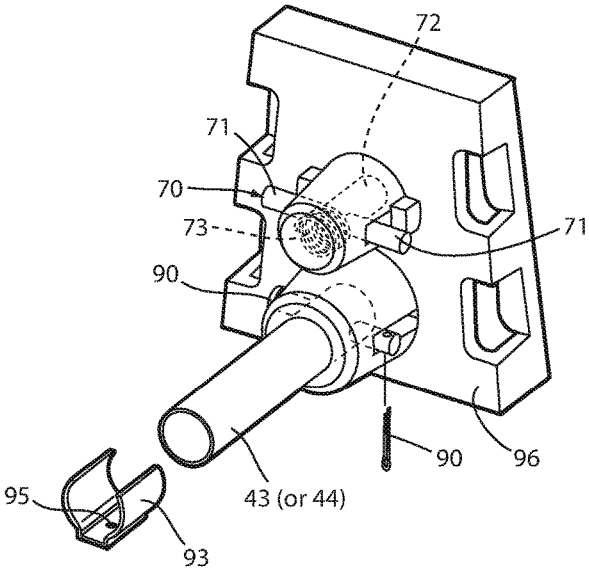

FIG. 9B is a cross sectional view similar to FIG. 9A, but showing the removal adapter 34 with fingers 82 engaging and holding the retainer 70 in its disengaged/release position. FIGS. 9C-9E are additional perspective views of the mounting bracket 32 from FIG. 7, showing a relationship of the mounting bracket 32, the retainer 70, and the retainer-biasing spring 73. FIGS. 9C-9E also show a relationship of the rod 44 (or 45), rod-anchoring components securing rods to the mounting bracket 32, and a banner clip holding the banner 40 to the rod 44 (or 45). The banner rods 43 and 44 are shown as hollow metal tubes, but it is contemplated that they may also be a solid or filled, and can be plastic or another material. The rod 43 (and rod 44) includes a hole, and an anchoring pin 90 that extends through a hole in the rod 43 (and 44), with the anchoring pin 90 also extending through holes/slots 91 in the boss 61 of the mounting bracket 32 to retain the rod securely to the mounting bracket 32. It is contemplated that the anchoring pin 90 can be a bolt or spring clip or other attachment member that self-secures (or that frictionally engages) into the mounting bracket 32 so that the anchoring pin 90 does not inadvertently come loose. It is contemplated that the rods 44/45 can be friction-fit or adhered or bonded inside the mounting bracket 32. A U-shaped resilient banner-securing clip 93 snaps over the banner sheet 41 onto the rod 43 (or 44), thus securing the banner sheet 41 to the rod 43 (or 44). A zip tie 94 (or other anchoring strap) is extended through a hole 95 in the clip 93 and through a hole or apertured flange or other feature (such as at location 96) on the mounting bracket 32 or on the base 31. Thus, the clip 93 remains secured to the mounting bracket 32 (i.e. thus preventing the clip 93 from "walking" toward an outer end of the rod 43 (or rod 44) where it would fall off the rod 43 (or rod 44). The banner 40 includes a lower chamber sewn into the banner to receive the rod(s). The outer end of the illustrated banner 40 is fixed to the outer end of the rod by sewing a closed end on the banner . . . and/or by a cap or cup-shaped member that keeps the banner on the outer end of the rod.

The install adapter 33 (FIG. 8, and see FIG. 10) is a metal or polymeric molded U-shaped body with downwardly-extending channels 75, 76 connected by cross member 77. The channels 75, 76 are shaped to matably engage the outer sides of the mounting bracket 32. Leaf springs 78 extend downward from the ends of the channels 75, 76 (or can be positioned inside of the channels) and include an inwardly radiused portion 80 that extends slightly inboard of the cavity defined between the channels 75, 76. When the mounting bracket 32 is positioned in the install adapter 33, the radiused ends 80 of the leaf springs 78 resiliently flex to allow the mounting bracket 32 to be positioned in the install adapter 33, and then flex to engage a bottom of the mounting bracket 32 to retain the mounting bracket 32 to the install adapter 33 as a unit. This allows a person holding the extendable pole 38 (FIGS. 10, 1-3) to manipulate the pole to position the mounting bracket 32 over a mating base 31. With a downward movement of the extendable pole 38, the mounting bracket 32 is pulled into mating engagement with the base 31. With a subsequent upward movement, the install adapter 33 is pulled out of the mounting bracket 32, with the leaf springs 78 flexing to release the mounting bracket 32. It is easiest to attach the top mounting bracket first, and then the bottom mounting bracket, but alternative methods can be used if desired.

Figure 10:
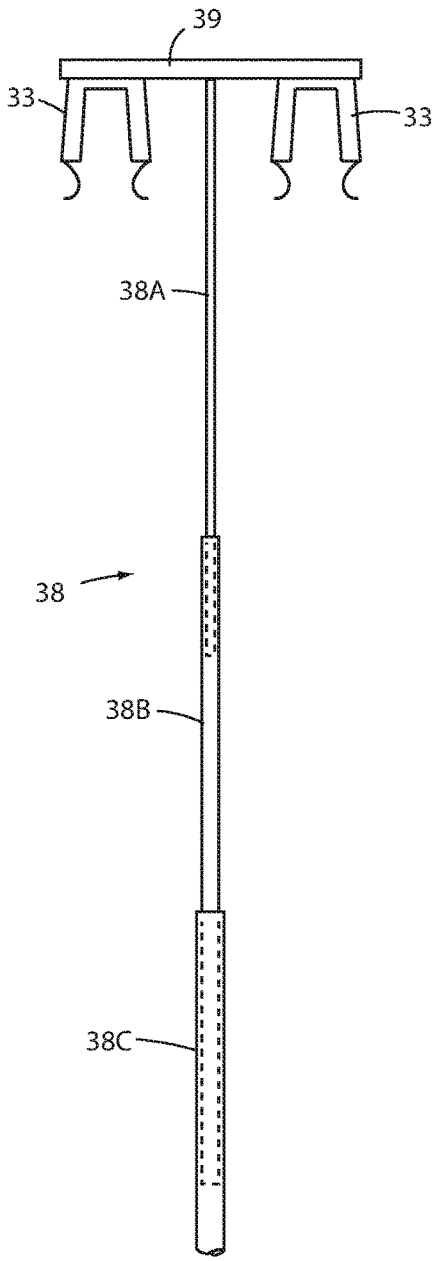
FIGS. 10-11 are side and front views of the telescopingly extendable pole with install adapter at its top end, similar to that shown in FIG. 1.
Figure 11:
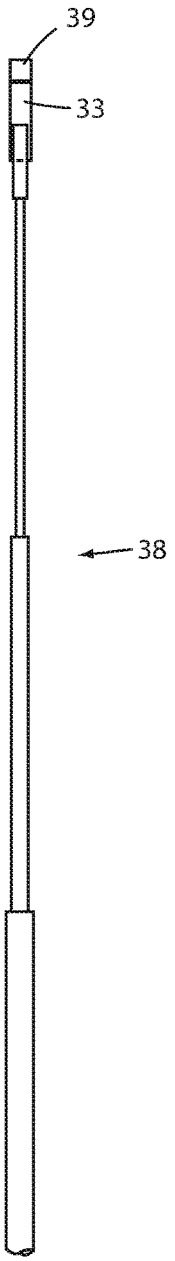

FIGS. 10-11 show the extendable pole 38 with transverse bar 39 supporting two down-facing install adapters 33. The extendable pole 38 includes multiple tubular sections 38A, 38B, 38C (or more) that can be telescopingly extended or retracted as needed by the worker to accomplish the present task. The illustrated pole 38 has multiple sections that do not spin relative to each other, such as a non-circular cross section, thus giving the installing person more control during an installation sequence. Extendable poles 38 are well known and commercially available, such that a more detailed description is not required herein for an understanding by persons skilled in this art.

The present apparatus 30 also includes a removal adapter 34 (FIGS. 12-13) for removing a mounting bracket 32 from a base 31 from a remote position on the ground. The illustrated removal adapter 34 includes an up-facing U-shaped body with fingers 82, 83 connected by a cross member 84. The fingers 82, 83 are spaced apart sufficiently to fit on opposite sides of the protrusions 65, 67 of the mounting bracket 32. Further, the tips 85, 86 of fingers 82, 83 are tapered or wedge-shaped and angled so that the tips 85, 86 will slip under the arms 71, causing release of the retainer 70 from the latching hole 66 for removal. (See FIGS. 9B and 12.)

Figure 16:
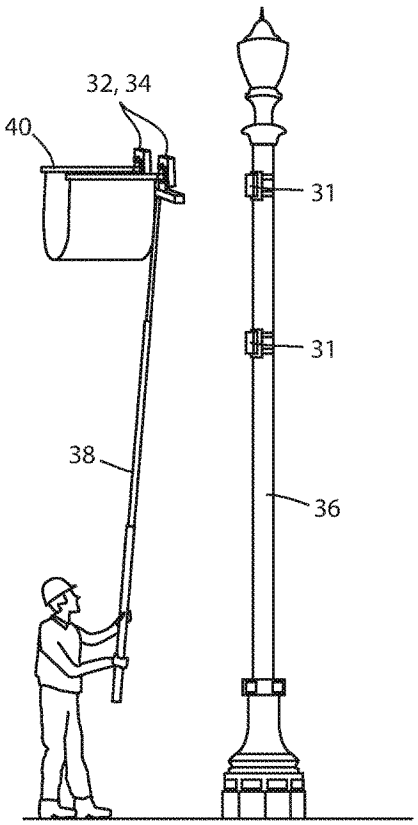
FIGS. 14-16 are elevational views using the pole tool with install adapters of FIG. 13, showing sequentially removing the banner/mounting brackets from the bases on the light pole.
Figure 15:
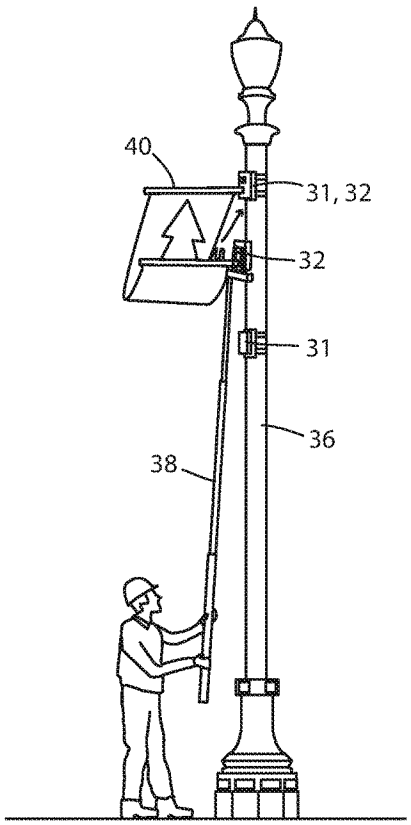
Figure 14:
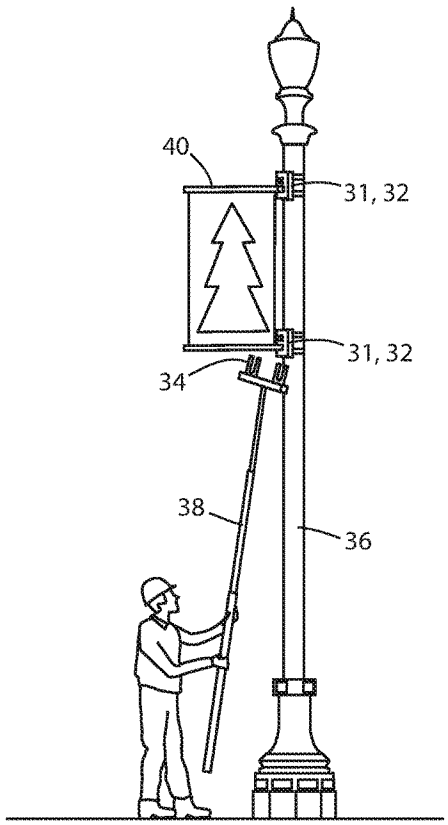

FIG. 13 illustrates a pole-mounted tool with two down-facing install adapters 33 and two up-facing removal adapters 34 installed on a single transverse bar 39 on the upper end of the extendable pole 38. FIGS. 14-16 illustrate a method of removing a banner 40 from an upright structure 36, including positioning the pole 38 (FIG. 14) so that the removal adapter 34 is under the lower mounting bracket 32 and pressing upward to release the retainer 70 and remove the lower mounting bracket 32 (see FIG. 15), and then repeating the process on the upper mounting bracket 32 (FIG. 16).

The present apparatus 30 allows installation of a banner 40 while standing on the ground, and also allows later removal of the banner 40 while standing on the ground. No separate loose fasteners are required. Notably, where the pole tool has both installer adapters and removal adapters, the present apparatus allows a worker to remove an existing hanging banner 40 and then immediately install a new replacement banner 40 without lowering his extendable pole 38, thus saving considerable time in the process. For example, the pole tool 38 illustrated in FIG. 13 allows this.

While the present drawings and illustrations show the banner 40 mounted to a street light pole 36, it is specifically contemplated that the present apparatus and innovative features can be used to mount banners on telephone poles, building walls, billboards, bleachers, roofs, and virtually any upright structure that will support a banner and give good visibility. The present apparatus and innovative features can be used by city, state, and federal governments, as well as by teams, businesses, and any other entity wanting to hang a banner for advertising or other purposes.

MODIFICATION

Figure 17:
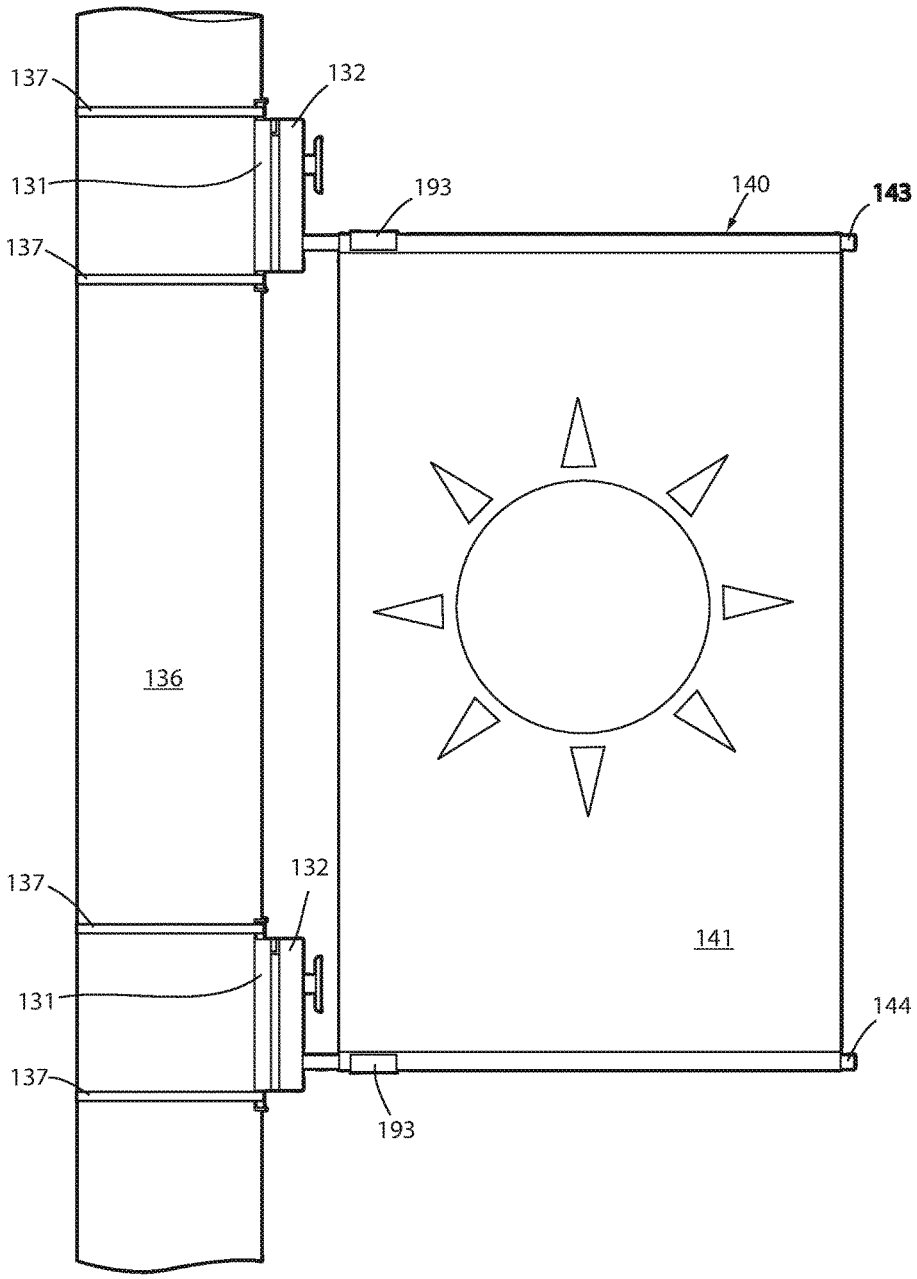
FIG. 17 is a fragmentary elevational view similar to FIG. 3, but showing a banner held by a modified attachment system including two modified bases and two modified mounting brackets.
Figure 18:
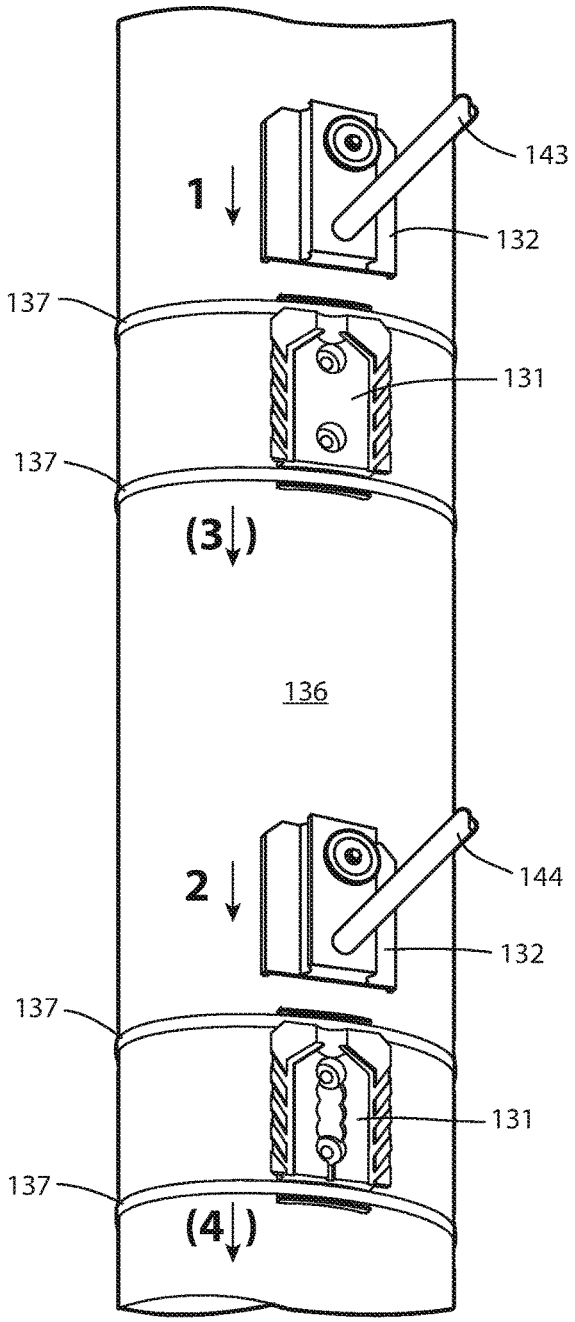
FIG. 18 is an exploded perspective view of FIG. 17, showing the banner-carrying mounting brackets exploded from a pair of the street-light-pole-mounted bases.
Figure 20:
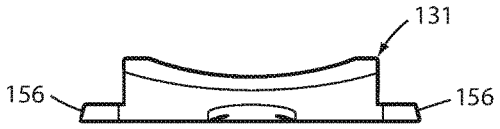
FIGS. 19-23 are front, top, side, bottom and back views of the base of FIG. 18.
Figure 19:
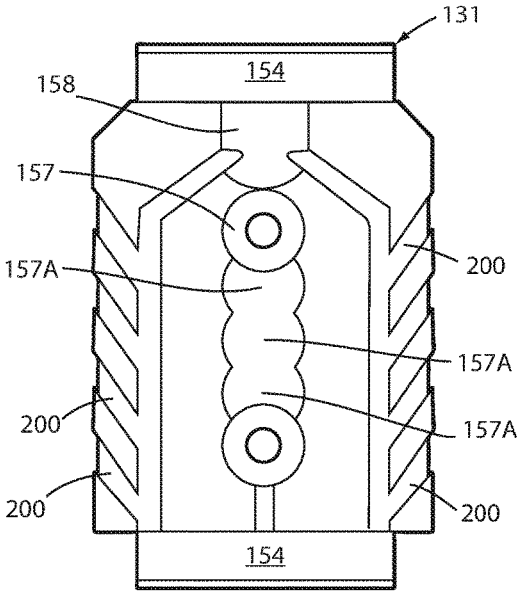
Figure 21:
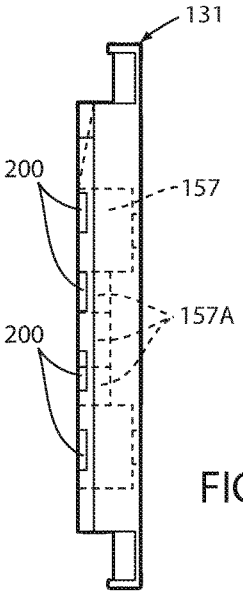
Figure 35:
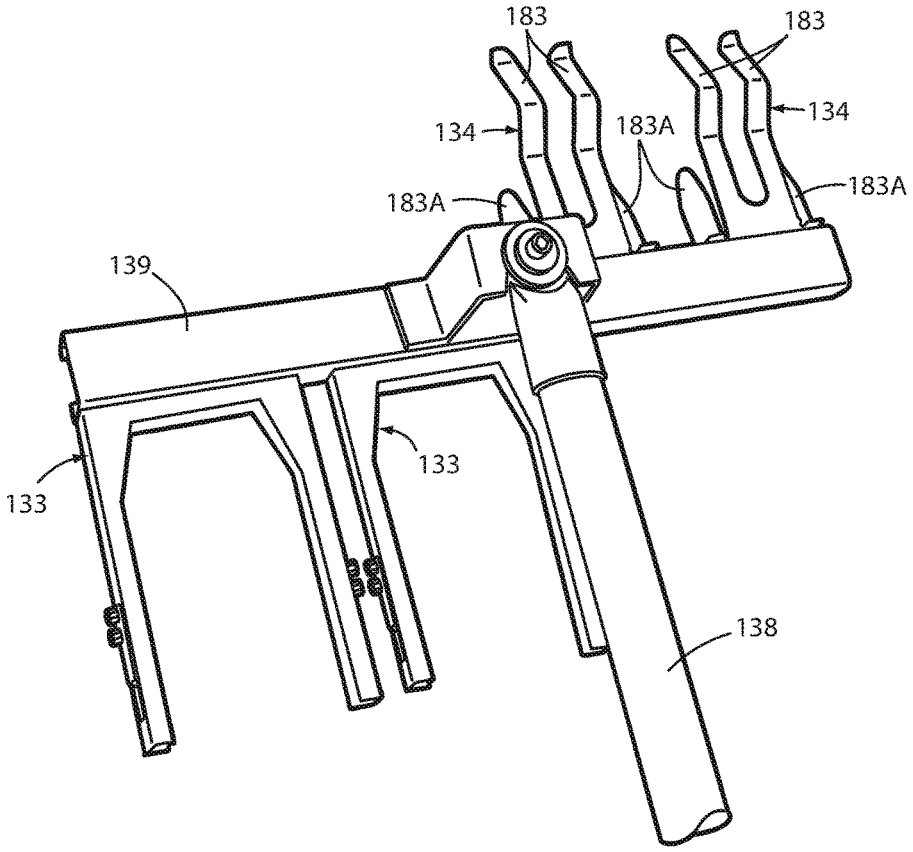
FIG. 35 is a perspective view of a pole-attached tool including two down-facing installer adapters on a left side and two up-facing removal adapters on a right side.
Figure 36:
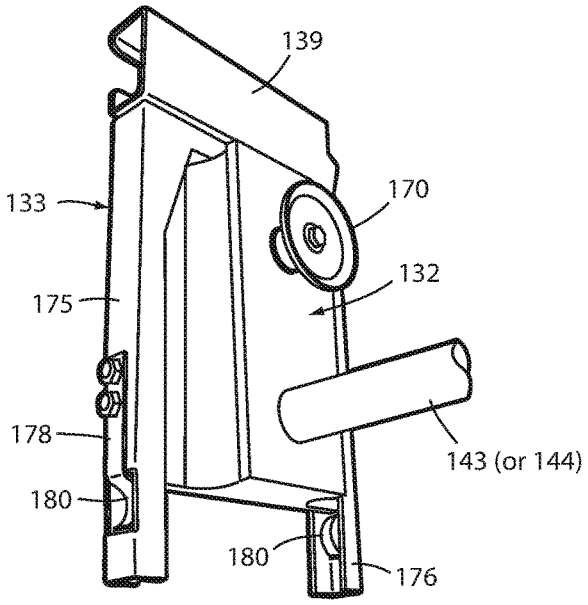
FIG. 36 is a perspective view showing a mounting bracket releasably held in the installer adapter of FIG. 35.
Figure 37:
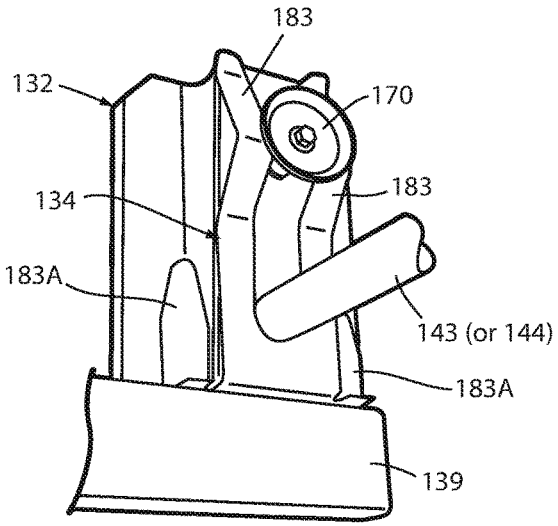
FIG. 37 is a perspective view showing a mounting bracket held in the remover adapter, with leaf-spring prongs on the remover adapter engaging the spring-biased retainer on the mounting bracket to hold the retainer in its release position, and bullet-nose alignment prongs centering the removal adapter on the mounting bracket.

A modified attachment system/apparatus (also called a "system") (FIGS. 17-18) includes bases 131, mounting brackets 132, and a pole-mounted tool 138 having install adapters 133 (FIGS. 35, 36), and removal adapters 134 (FIGS. 35, 37). These components combine and cooperate to allow a worker to install a banner 140 high in the air (such as 15-18 feet in the air) while standing on the ground. These components function and interrelate similarly to the components of apparatus 30, and are identified by using the same numbers but with the number 100 added to the identifying number. This is done to reduce redundant discussion. As will be understood by persons skilled in this art, it is intended that the functional discussion above also applies to the modified components described below.

Figure 22:
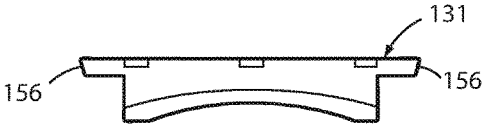
Figure 23:
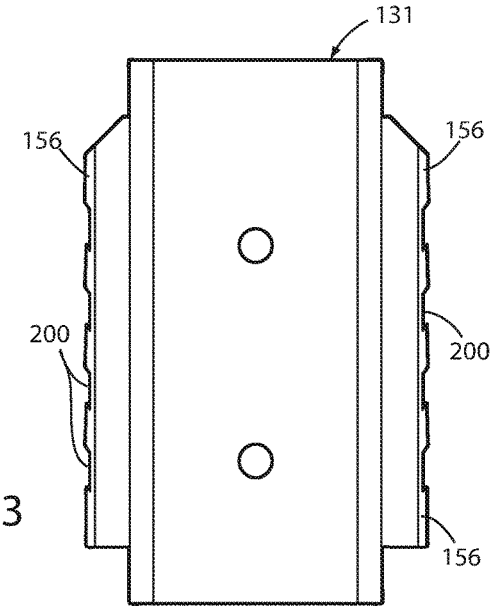
Figure 25:
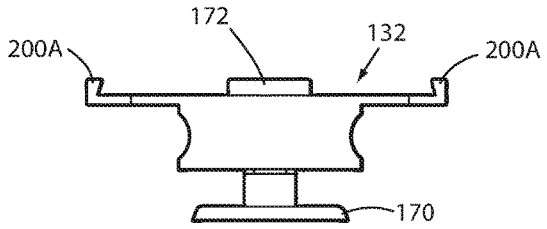
FIGS. 24-28 are front, top, side, bottom and back views of the mounting bracket of FIG. 18.
Figure 24:
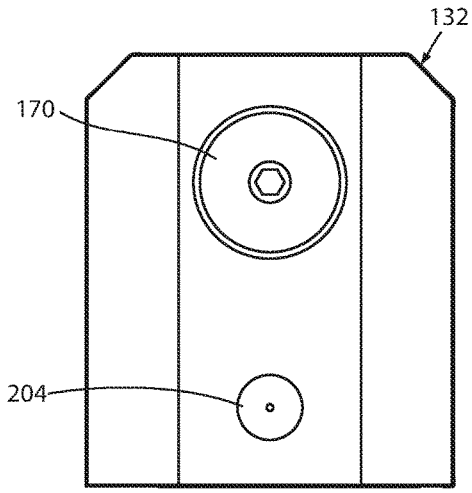
Figure 26:
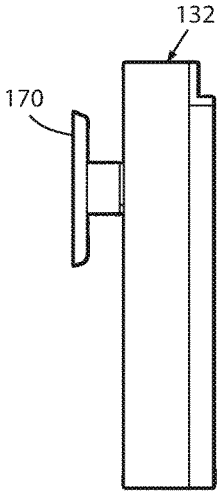
Figure 27:
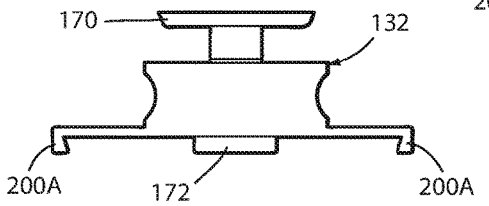
Figure 28:
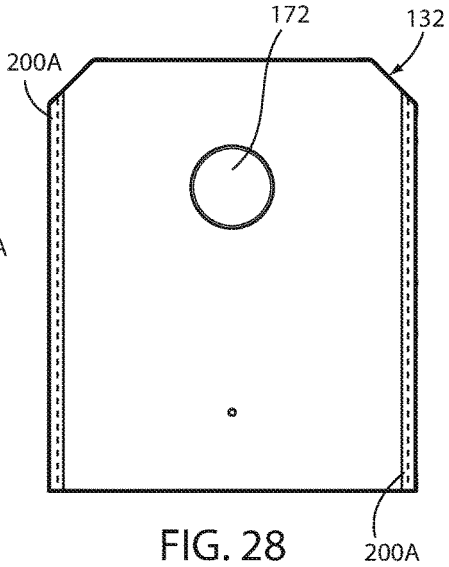
Figure 29:
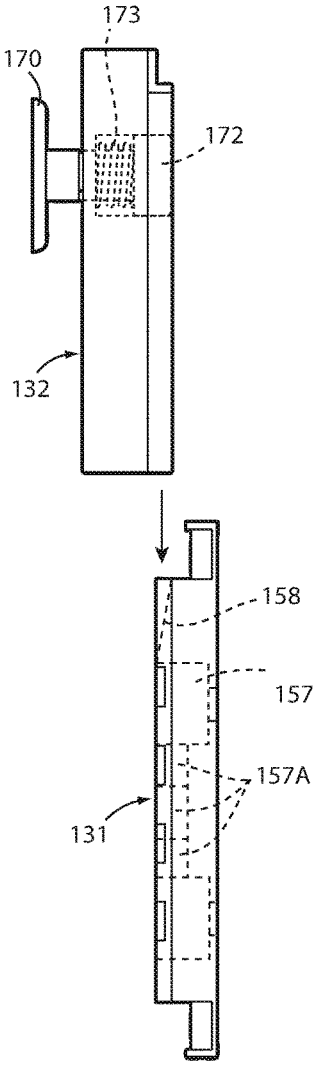
FIGS. 29-32 are side views showing installation of the mounting bracket onto a mating base (see FIGS. 17-18), FIG. 32 showing the mounting bracket locked at a top locked position on the base.
Figure 30:
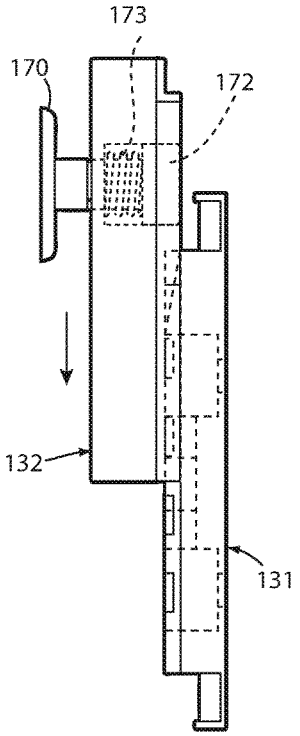
Figure 31:
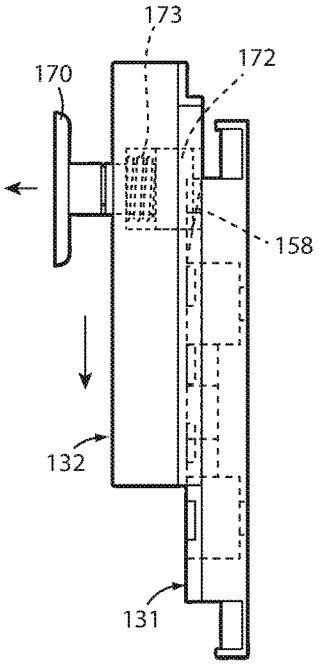

The base 131 (FIGS. 19-23) is modified from the base 31 described above to be thinner, lighter weight, lower cost, more robust and durable, easier to manufacture, and generally structurally better for being made from a polymeric or composite material (reinforced or not reinforced) intended for outdoor use. The base 131 includes a curved back side (FIG. 22, 23) shaped to engage a pole support (such as a street light post), and a front side with bracket-engaging edge flanges 156, retainer-tip-receiving hole 157, and ramp 158. Top and bottom lateral flanges 154 are shaped to receive a band extended around the street light post for clampingly securing the base 131 to a pole, such as the illustrated street light post. Angled channels 200 form a feather pattern for channeling moisture out a bottom of the base 131. This can be important when the base 131 is in an outdoor environment, since rain, ice, and other debris can penetrate and/or freeze between the base 131 and an installed mounting bracket 132 causing problems.

The illustrated base 131 has a second retainer-tip-receiving hole 157A (or several such additional holes) and a channel leading from hole 157 to hole 157A. If top and bottom bases 131 are spaced apart a correct distance, the banner 140 will have a desired tension between the top and bottom banner-carrying rods 143 and 144. However, my testing suggests that an adjustment is desired because banners are inconsistent in length and/or may "grow" or stretch in a vertical direction during use (such as the banner stretching due to wind, rain, and outdoor elements). The illustrated base 131 includes a first hole 157 and second hole 157A that can be selectively engaged by the retainer 170 to support the banner 140 in a "best tensioned" condition. It is contemplated that a top base 131 may have a single hole 157 and the bottom base 131 may have two holes 157 and 157A, or that both can have two (or more) holes 157. The second hole 157A can engaged by the retainer 170 in different ways. For example, the retainer 170 can be engaged with the first hole 157 during initial installation. Then, the removal adapter 134 can be used to disengage the retainer 170 of the bottom mounting bracket 132 and move the mounting bracket 132 down to the second hole 157A, which applies greater spacing to the rods 144, 145 and thus more tension to the banner 140.

The mounting bracket 132 (FIGS. 24-28) includes a body with vertical edge flanges 200A that slidably engage the bracket-engaging edge flanges 156. The illustrated mating surfaces of the flanges 156 and 200A are angled inwardly on opposite sides to create a dove-tail like connection, but it is contemplated that the flanges could be squared-off edges of a plate shaped to engage a "square" channel, or could be another similarly-functional configuration. The retainer 170 is mounted in a center area and spring biased by spring 173 to a locked position. The retainer 170 includes a shaft with tip 172 shaped to engage the hole 157 (or 157A) in the base 131. The retainer 170 includes a large washer-like head that can be engaged by the arms 183 of the removal adapter 134 (FIG. 35, 37). A second hole 204 on the mounting bracket 132 is located below the retainer 170 and provides a fastener-access point where a screw or zip tie other fastener can be placed.

Figure 32:
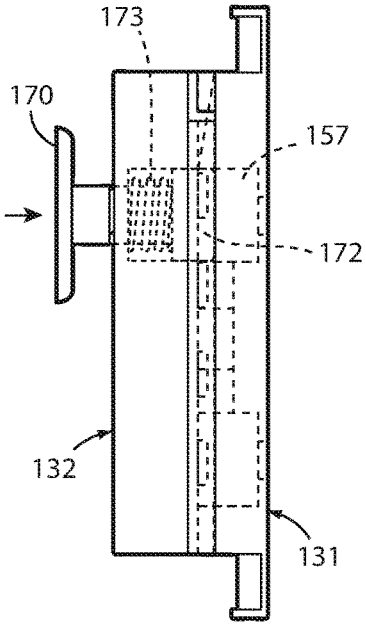
Figure 33:
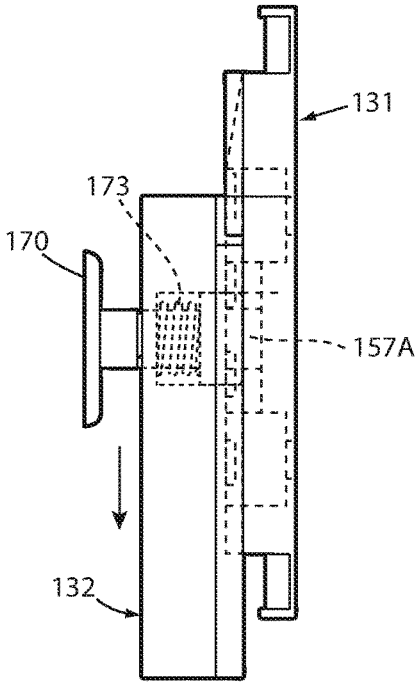
FIG. 33 is a side view similar to FIG. 32, but showing that during installation, the mounting bracket can be adjusted to a lower locked position on the base.
Figure 34:
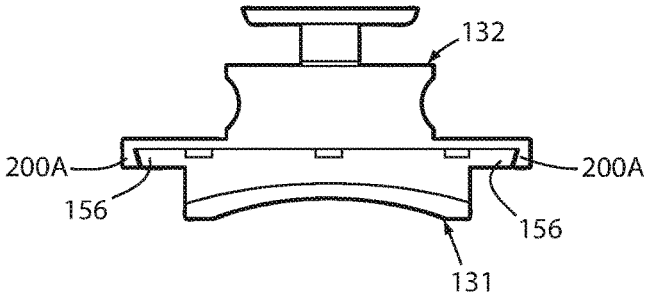
FIG. 34 is a horizontal cross section through FIG. 32 (or FIG. 33) showing a relationship of the mounting bracket to the base, including sliding engagement of mating flanges.
Figures 38, 39, 40:
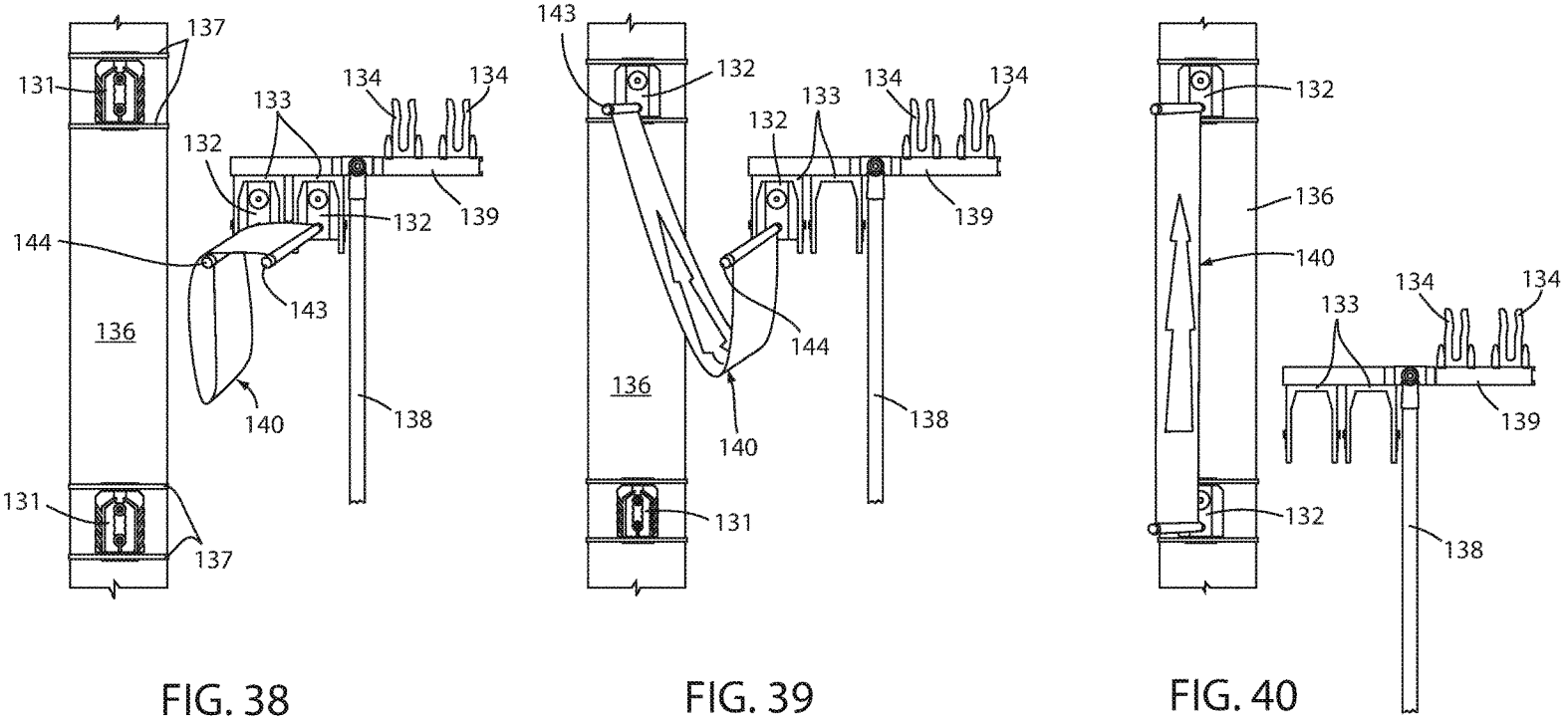
FIGS. 38-40 are views similar to FIGS. 1-3, but showing the modified attachment system of FIGS. 17-18, 35, FIG. 38 showing pre-install positions, FIG. 39 showing a top mounting bracket installed on a pole-attached base but showing the bottom mounting bracket still attached to the installer adapter on the pole tool, and FIG. 40 showing a fully attached banner with top and bottom mounting brackets attached to spaced-apart bases on the street light pole.

Installation proceeds as follows (FIGS. 38-40). The bases 131 are pre-installed on a support structure in a desired spaced-apart relationship (FIG. 38). Two mounting brackets 132 (with rods 143,144 fixed therein) are releasably engaged on the install adapters 133 on the pole tool 138, with the banner 140 hanging between the rods (FIG. 38). The extendable pole 138 is used to manipulate the top mounting bracket 132 into engagement with the top base 131 (see FIGS. 29-31 and 39), and then secondly to engage the bottom mounting bracket 132 into the bottom base 131 (see FIG. 40). Once both mounting brackets 132 are attached to respective bases 131, the banner 140 (including sheet 141 and rods 143,144) are supported on the upright structure 136, with the banner 140 spread out between the rods 143,144 in a readable position (FIG. 40). If desired, the removal adapter 134 can be used to move the retainer 170 to a lower hole 157A (FIGS. 32-33). After installation, the extendable pole 138 with install adapters 133 can be pulled away. Notably, the present system does not require any separate loose fasteners, thus allowing remote manual installation without the need for separate hand tools or lift trucks or ladders, and hence is much safer, faster to install, and less frustrating than previous methods.

Figure 42:
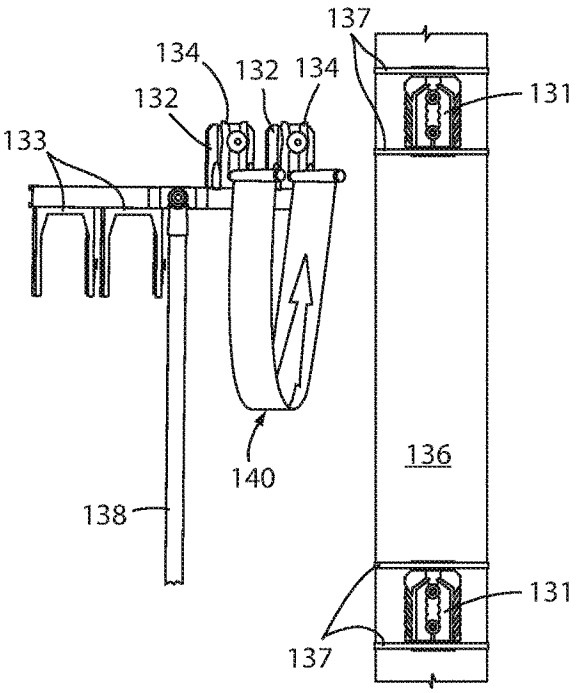
FIGS. 41-42 are views similar to FIGS. 15-16, but showing the modified system of FIGS. 17-18, 35, FIG. 41 showing the bottom mounting bracket released and on the pole tool but the top mounting bracket still attached to the top base on the street light pole, and FIG. 42 showing a completely unattached banner with top and bottom mounting brackets carried by spaced-apart remover adapters on the poll tool.
Figure 41:
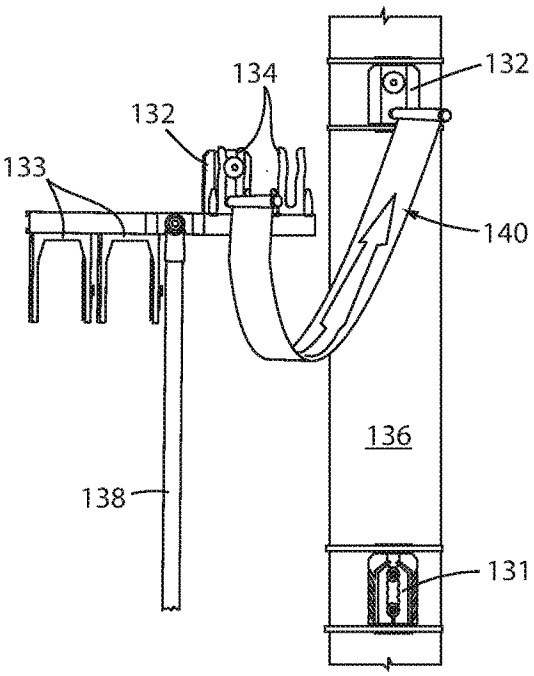
Figure 43:
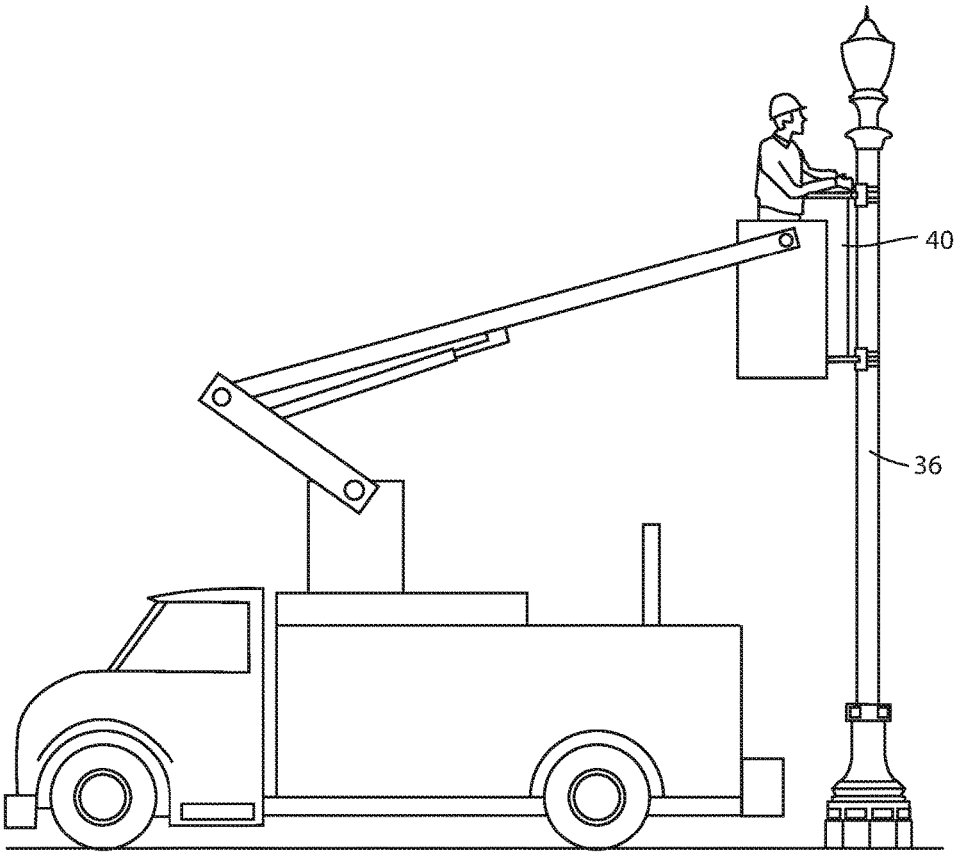
FIG. 43 (Prior Art)
FIG. 43 is an elevational view showing a prior art method of installation.

To remove the banner 140 (FIGS. 41-42), the pole tool with removal adapters 134 is used to first engage the lower mounting bracket 132 (FIG. 41), so that with an upward movement the arms 183 engage the head of the retainer 170 to disengage it (i.e. "unlock it"), causing the mounting bracket 132 to release and slide upwardly off the base 131. The removal adapters 134 include bent-leaf-spring members 183, and also include bullet-shaped projections 183A that engage a center of the mounting bracket to align the adapter 134 on a selected mounting bracket 132 during removal. A similar procedure is used to remove the top mounting bracket 132 (FIG. 42). If desired, both the removal of a first banner 140 and installation of a second banner 140 can be done in a single sequence without lowering the pole tool 138.

Thus, it is to be understood that variations and modifications can be made on the aforementioned structure without departing from the concepts of the present invention, and further it is to be understood that such concepts are intended to be covered by the following claims unless these claims by their language expressly state otherwise.

The invention claimed is:

1. An apparatus for hanging a banner on an upright structure, comprising:

a base configured for attachment to the upright structure;

a mounting bracket with vertically-oriented opposing edge flanges constructed to vertically releasably engage the base while supporting the banner; and an installation tool including an install adapter with edge-flange-engaging sections constructed to interlockingly vertically engage and releasably carry the mounting bracket but release when the mounting bracket is secured to the base.

2. The apparatus of claim 1, wherein the edge flanges and edge-flange-engaging sections of the base and the mounting bracket form mating connectors constructed to engage and later disengage without using separate loose fasteners.

3. The apparatus of claim 1, wherein the install adapter includes carrying structure for engaging and holding the mounting bracket during an install, but configured to release the mounting bracket after the install.

4. The apparatus of claim 1, including a pole tool, the install adapter being mounted on an end of the pole tool.

5. The apparatus of claim 4, including a removal adapter also mounted to the end of the pole tool.

6. An apparatus for removing a banner hung on an upright structure, comprising:

a base configured for attachment to the upright structure;

a mounting bracket engaging the base and supporting the banner, the mounting bracket including a retainer-biasing spring and a spring-biased retainer movable supported on the mounting bracket and configured to releasably interlockingly secure the mounting bracket to the base; and a removal adapter including a retainer-engaging member constructed to engage the retainer on the mounting bracket to release the mounting bracket from the base; the base and the removal adapter each being constructed to engage and disengage the mounting bracket without using separate loose fasteners.

7. The apparatus of claim 1, wherein the installation tool includes a pole supporting the install adapter.

8. The apparatus of claim 7, wherein the pole is telescopingly extendable, and the at least one install adapter is mounted on an end of the pole opposite a handle of the pole.

9. The apparatus of claim 1, wherein the mounting bracket includes a retainer engaging the base to positively retain the mounting bracket to the base in an installed position.

10. An apparatus for hanging a banner on an upright structure, comprising:

a base having first flanges to receive a band retainer for attaching the base to the upright structure and having second flanges defining a bracket-holding cavity;

a mounting bracket having a mating portion shaped to wedgingly fit into the bracket-holding cavity and having a friction-generating retainer for holding the mounting bracket to the base, the retainer having a shaft slidably supported on the mounting bracket and an enlarged head on the shaft, and the mounting bracket also having a rod-supporting structure for supporting a banner-carrying rod; and an install adapter constructed to hold the mounting bracket during installation into the bracket-holding cavity, and constructed to then release the mounting bracket once the retainer frictionally engages the base.

11. The apparatus of claim 10, wherein the friction-generating retainer includes a spring-biased locking member, and including a removal tool with a finger constructed to engage the locking member to release the mounting bracket from the base.

12. A method for hanging a banner on an upright structure, comprising:

providing a base configured for attachment to the upright structure;

providing a mounting bracket with a retainer supported on the mounting bracket for movement between bracket-locked position and a bracket-released position, and a retainer-biasing spring constructed to cause the retainer to securely but releasably engage the base while the mounting bracket is supporting the banner on the base;

providing an install adapter constructed to releasably hold the mounting bracket and then release when the mounting bracket is secured to the base;

attaching the mounting bracket to the install adapter and then using the install adapter to install the mounting bracket to the base with the retainer securely interlockingly engaging the base without using separate fasteners; and disengaging the install adapter from the mounting bracket.

13. A method for installing a banner hung on an upright structure, comprising:

providing a base with vertically-oriented opposing flanges, and a banner-carrying mounting bracket with mating flanges adapted to engage the opposing flanges of the base; and using a pole-mounted install adapter to engage and carry the mounting bracket, then cause the mating flanges of the mounting bracket to vertically interlockingly engage the opposing flanges of the base without using separate loose fasteners, with the install adapter releasing the mounting bracket after the mounting bracket is attached to the base.

14. A method for removing a banner hung on an upright structure, comprising:

providing a base and a banner-carrying mounting bracket attached to the base, the mounting bracket including a retainer and a biasing spring that biases the retainer from a release position toward a bracket-interlocked position; and using a pole-mounted removal adapter to engage and move the retainer to the release position to release the mounting bracket and then to remove the mounting bracket from the base.

15. An apparatus for hanging a banner on an upright structure, comprising:

top and bottom bases each configured for attachment to the upright structure in a vertically spaced relationship;

top and bottom mounting brackets each constructed to releasably engage an associated one of the bases while supporting the banner in a vertical installed position where the banner defines a vertical dimension; and an installation tool including first and second install adapters carried at a spaced dimension different than the vertical dimension, each of the first and second install adapters being constructed to releasably and simultaneously carry the banner along with the top and bottom mounting brackets, respectively, but constructed to individually release as the mounting brackets are sequentially secured to the associated top and bottom bases at a spacing equal to the vertical dimension.

16. The apparatus of claim 15, wherein the top and bottom bases and the top and bottom mounting brackets include vertically-oriented mating flanges.

17. The apparatus of claim 16, wherein the mating flanges define a dovetail-shaped connection.

18. An apparatus for hanging a banner on an upright structure, comprising:

a base configured for attachment to the upright structure and having vertically-oriented bracket-supporting flanges; and a mounting bracket having banner-supporting structure and including base-engaging mating flanges constructed to releasably engage the bracket-supporting flanges of the base in a vertical direction while supporting the banner;

one of the base and the mounting bracket including a retainer supported for movement in a non-vertical direction and configured to interlockingly engage the other of the base and mounting bracket to releasably retain them together.

19. The apparatus of claim 18, wherein the retainer includes a slidably-supported shaft and an enlarged head on one end of the shaft to facilitate operating the retainer.

20. The apparatus of claim 18, wherein the retainer includes a locking tip, and wherein the other of the base and the mounting bracket includes a plurality of interlock features selectively engageable by the tip, with each of the plurality of interlock features defining a different adjusted position of the mounting bracket on the base, whereby the mounting bracket can be adjustably secured in any of the different adjusted positions on the base.

21. The apparatus of claim 20, wherein interlock features define different vertically-aligned holes on the base.

* * * * *